US006580881B2

(12) United States Patent
Coriale et al.

(10) Patent No.: US 6,580,881 B2
(45) Date of Patent: Jun. 17, 2003

(54) METHOD OF DETECTING WASTE TONER IN A CONTAINER OF AN IMAGE FORMING APPARATUS

(75) Inventors: Matthew Christopher Coriale, Lexington, KY (US); Jonathan Carey Frey, Lexington, KY (US); Harald Portig, Versailles, KY (US); John Parker Richey, Lexington, KY (US); Wen-hsiung Adam Tseng, Lexington, KY (US); Liqun Larry Wang, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/970,829

(22) Filed: Oct. 4, 2001

(65) Prior Publication Data

US 2003/0068167 A1 Apr. 10, 2003

(51) Int. Cl.[7] ..... G03G 15/08; G03G 21/12
(52) U.S. Cl. ..... 399/35; 399/27
(58) Field of Search ..... 399/27, 35, 96, 399/120, 159, 358; 222/DIG. 1

(56) References Cited

U.S. PATENT DOCUMENTS

| | | | | |
|---|---|---|---|---|
| 3,912,388 | A | 10/1975 | Takahashi et al. | |
| 4,218,126 | A | 8/1980 | Takeichi | |
| 4,297,021 | A | 10/1981 | Tani et al. | |
| 4,370,053 | A | 1/1983 | Hirayama et al. | |
| 4,558,659 | A | 12/1985 | Alden | 118/653 |
| 4,593,997 | A | 6/1986 | Fox et al. | |
| 4,630,653 | A | 12/1986 | Kan | 141/83 |
| 4,682,874 | A | 7/1987 | Fantuzzo | |
| 4,687,320 | A | 8/1987 | Nakanishi et al. | |
| 4,730,205 | A | 3/1988 | Ogiri et al. | |
| 4,868,599 | A | 9/1989 | Niki | |
| 4,978,997 | A | 12/1990 | Bell | |
| 4,982,230 | A | 1/1991 | Ogura et al. | |
| 4,982,231 | A | 1/1991 | Matsuuchi | |
| 5,038,180 | A | 8/1991 | Niki | |
| 5,130,756 | A | 7/1992 | Taniyama | |
| 5,237,373 | A | 8/1993 | Aimoto et al. | |
| 5,285,250 | A | 2/1994 | Yoshioka | |
| 5,309,211 | A | 5/1994 | Yoshioka | |
| 5,355,199 | A | 10/1994 | Bray | |
| 5,383,578 | A | 1/1995 | Nishimura | 222/108 |
| 5,400,127 | A | 3/1995 | Arai et al. | |
| 5,465,619 | A | 11/1995 | Sotack et al. | 73/304 |
| 5,500,716 | A | 3/1996 | Morishita et al. | |
| 5,508,794 | A | 4/1996 | Ikesue et al. | |
| 5,579,094 | A | 11/1996 | Behe et al. | |
| 5,581,342 | A | 12/1996 | Yamauchi | |
| 5,614,996 | A | 3/1997 | Tanda | 399/120 |
| 5,617,195 | A * | 4/1997 | Torimaru et al. | 399/27 |
| 5,715,512 | A | 2/1998 | Kumagai | 399/349 |
| 5,781,841 | A | 7/1998 | Kouroku et al. | 399/360 |
| 5,839,017 | A | 11/1998 | Mordenga | 399/35 |
| 5,848,342 | A | 12/1998 | Tanda | 339/358 |
| 5,887,224 | A | 3/1999 | Mizuishi et al. | 399/62 |
| 5,918,085 | A | 6/1999 | Rollins et al. | 399/27 |
| 5,937,252 | A | 8/1999 | Peters, Jr. et al. | 399/256 |
| 6,014,541 | A | 1/2000 | Kato et al. | 399/358 |
| 6,128,453 | A | 10/2000 | Ban et al. | 399/106 |
| 6,157,792 | A | 12/2000 | Mori et al. | 399/24 |
| 6,213,583 | B1 | 4/2001 | Therien | 347/36 |
| 6,308,017 | B1 | 10/2001 | Taniyama et al. | 399/35 |

* cited by examiner

*Primary Examiner*—Hoang Ngo
(74) *Attorney, Agent, or Firm*—Taylor & Aust, P.C.

(57) ABSTRACT

Waste toner is detected in a container of an image forming apparatus. An auger is provided within the container. A switch is provided which is operable depending upon a torque associated with operation of the auger. A frequency of activation of the switch is detected. A "not full", "near full" and "full" condition of the waste toner in the container is determined depending upon the frequency of activation of the switch.

20 Claims, 2 Drawing Sheets

METHOD OF DETECTING WASTE TONER IN A CONTAINER OF AN IMAGE FORMING APPARATUS

BACKGROUND OF THE INVENTION

1. Field of the Invention

The present invention relates to a method of detecting waste toner in an image forming apparatus, and, more particularly, to such a method utilizing axial movement of a drive shaft which drives an auger in a waste toner container.

2. Description of the Related Art

An image forming apparatus having an electrophotographic reproduction system includes an electrophotographic member such as a drum and/or intermediate transfer member (ITM) such as a belt. Waste toner and other debris are cleaned off the ITM belt and deposited into the central portion of a waste toner container where an auger drives the waste toner to both ends of the container. As the container approaches being full, the torque necessary to drive the auger increases. It is known to utilize the increased torque required to drive the auger to activate a switch to determine when the waste toner container is at a "full" condition requiring replacing of the waste toner container therefrom. Such a detection system uses only the presence of the signal from the switch to determine the "full" condition, and thus is subject to false signals associated with signal noise, variability of the drive mechanisms and conditions, mechanical noise and changing drive motor speeds.

What is needed in the art is an image forming apparatus which accurately detects when waste toner within the waste toner container is at a "near full" condition or "full" condition.

SUMMARY OF THE INVENTION

The present invention provides a method of detecting waste toner in a container of an image forming apparatus, wherein the frequency of activation of a mechanically operated switch is used to detect a "not full", "near full" and "full" condition of the waste toner within the waste toner container.

The invention comprises, in one form thereof, a method of detecting waste toner in a container of an image forming apparatus. An auger is provided within the container. A switch is provided which is operable depending upon a torque associated with operation of the auger. A frequency of activation of the switch is detected. A "not full", "near full" and "full" condition of the waste toner in the container is determined depending upon the frequency of activation of the switch.

The invention comprises, in another form thereof, a method of detecting waste toner in a container in an image forming apparatus. An auger is provided within the container. A switch is provided which is activateable depending upon a torque associated with operation of the auger. An enable timer is provided which counts an enable time beginning at each activation of the switch. An accumulator value is incremented based upon a first gain and a count value of the enable timer. The accumulator value is compared with a first threshold value and/or a second threshold value. A "not full", "near full" and "full" condition of the waste toner in the container is determined. The "not full" condition is determined if the accumulator value is less than the first threshold. The "near full" condition is determined if the accumulator value is greater than or equal to the first threshold value. The "full" condition is determined if the accumulator value is greater than or equal to the second threshold value.

An advantage of the present invention is that false indications caused by signal noise, etc. are avoided.

Another advantage is the methodology of the present invention may be carried out using known structure, thereby reducing cost.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
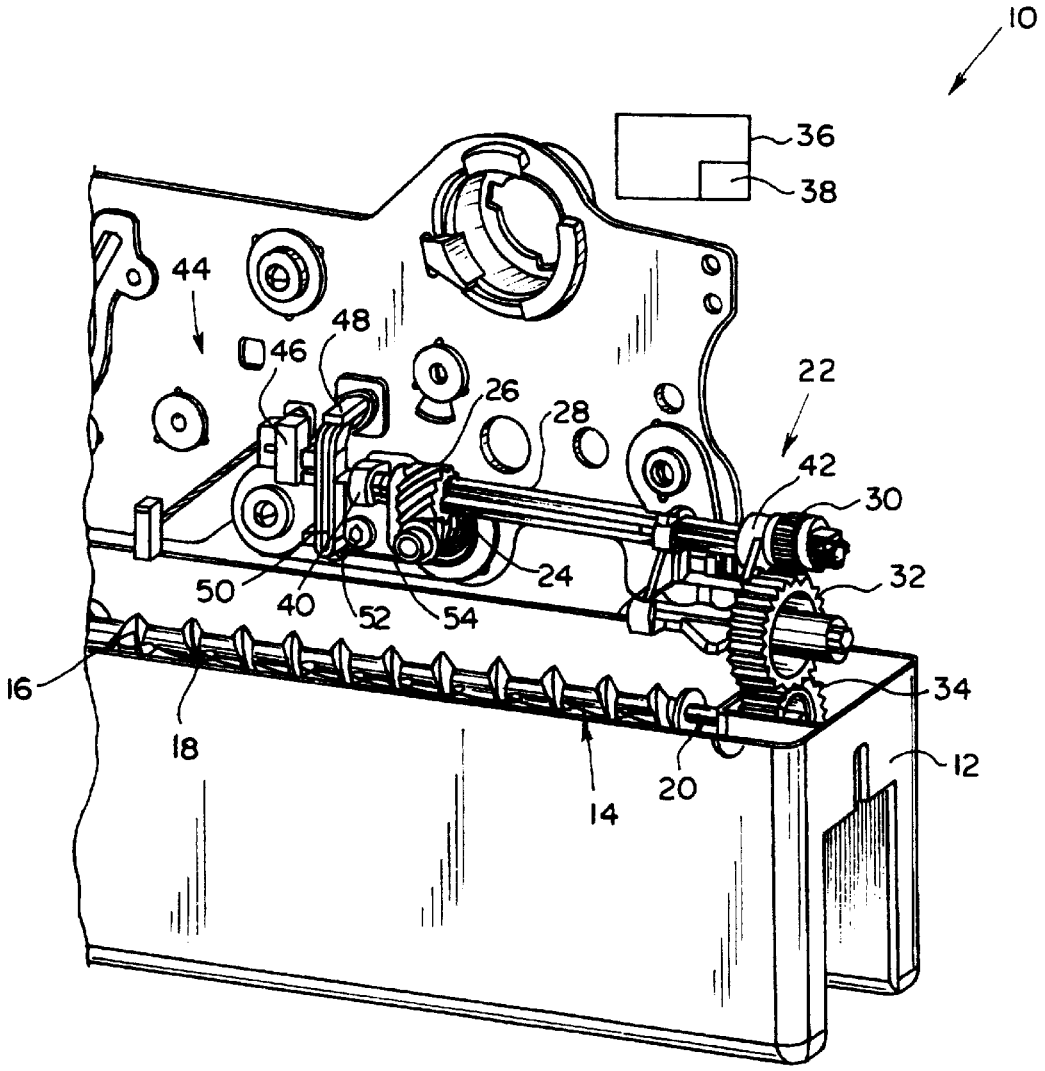
FIG. 1 is a fragmentary, perspective view of a portion of an image forming apparatus of the present invention.

Referring now to the drawings and particularly to FIG. 1, there is shown a portion of an embodiment of an image forming apparatus 10 of the present invention, in the form of an electrophotographic printer. In the embodiment shown, electrophotographic printer 10 also includes a plurality of printing stations (not shown) corresponding to a plurality of different color toners which are to be applied to a print medium. Each printing station includes a photoconductive drum, a developer roller and a toner hopper carrying a particular color toner, such as black, cyan, magenta or yellow. An intermediate transfer member in the form of an intermediate transfer belt (also not shown) carries the print medium past each of the printing stations. A cleaner removes untransferred toner and other debris from the intermediate transfer belt. Augers are utilized to transfer waste toner from the cleaner to waste toner container 12 (FIG. 1) through a plurality of ducts. An auger 14 positioned within waste toner container 12 includes opposite handed flitings (i.e., helical ridges) 16 and 18 which move the waste toner in opposite directions within waste toner container 12. Flitings 16 and 18 are carried by auger shaft 20.

Drive train 22 includes first drive gear 24, first driven gear 26, drive shaft 28, second drive gear 30, intermediate driven gear 32 and auger driven gear 34. First drive gear 24 is directly or indirectly driven by a drive motor, which in turn is actuated by a controller 36, shown schematically in FIG. 1. Controller 36 may be part of the engine controller, or may be a separate controller within printer 10. Controller 36 includes an enable timer 38 which will be described in more detail hereinafter. Enable timer 38 may be integral with or separate from and connected to controller 36.

First drive gear 24 drives first driven gear 26, which in turn is carried in a fixed manner on drive shaft 28. Drive shaft 28 is freely rotatably carried by and axially movable within bearings 40 and 42.

Second drive gear 30 is also rigidly fixed to and carried by drive shaft 28. Second drive gear 30 drives intermediate driven gear 32, which in turn drives auger driven gear 34 carried by auger shaft 20. Thus, actuation of first drive gear 24 in turn causes rotation of auger 14. The waste toner is deposited into waste toner container 12 at or near the junction of flitings 16 and 18 such that the waste toner is augered in opposite directions toward the opposite ends of waste toner container 12.

First drive gear 24 and first driven gear 26 are each formed as crossed helical gears which enmesh with each other and impart rotational torque to drive shaft 28. By forming first drive gear 24 and first driven gear 26 as crossed helical gears, an axial force component is also exerted on drive shaft 28 in addition to the rotational force component. This axial force component may cause axial movement of drive shaft 28 within bearings 40 and 42, as will be described in more detail hereinafter.

Switch assembly 44 includes a switch 46, pivot arm 48, first limit stop 50, second limit stop 52 and tension spring 54. Switch 46, in the embodiment shown, is a microswitch which is electrically connected with controller 36. First limit stop 50 and second limit stop 52 are positioned to mechanically limit the pivotal travel of pivot arm 48. First limit stop 50 prevents mechanical overload of microswitch 46. Second limit stop 52 defines a rest against which pivot arm 48 is biased using tension spring 54. The preload of pivot arm 48 against second limit stop 52 is predetermined using a preselected spring constant associated with tension spring 54. The preload of pivot arm 48 against second limit stop 52 determines the amount of force required to move pivot arm 48 against microswitch 46 using axial movement of drive shaft 28 caused by increased torque of auger 14 as waste toner container 12 becomes full with waste toner.

Figure 2:
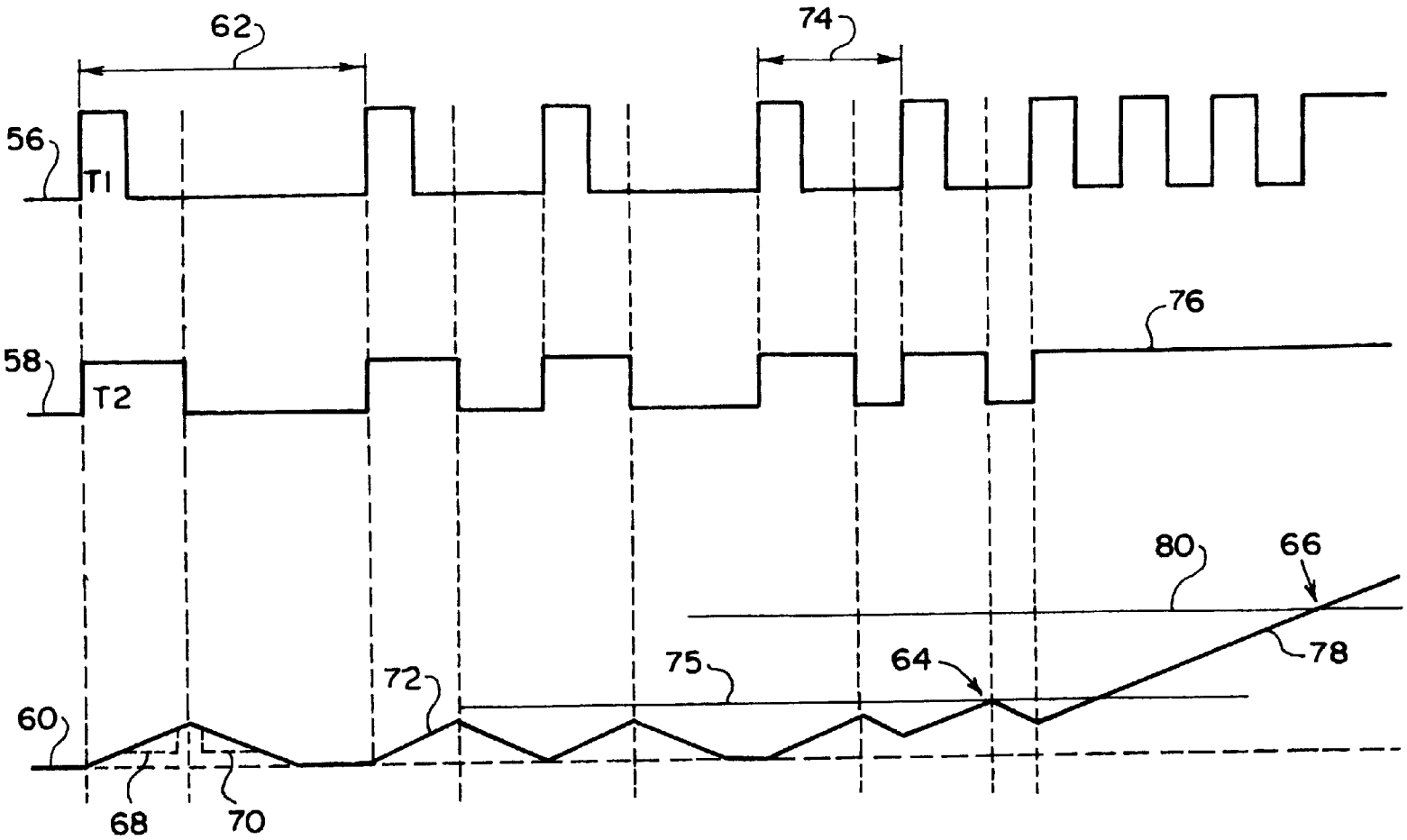
FIG. 2 is a graphical illustration of the switch activation signal, enable timer signal and accumulator value trace used to determine the state of the waste toner within the waste toner container in the image forming apparatus of FIG. 1.

Referring to FIG. 2, a signal response curve is shown corresponding to actuation of switch 46. Signal 56 represents the pulse train outputted by switch 46 to controller 36. Signal 58 represents an "enable time" signal generated by controller 36 using enable timer 38. Line 60 represents a "value" of an accumulator value maintained by controller 36 in response to signals 56 and 58.

As the waste toner becomes full within waste toner container 12, the amount of torque which is applied to auger 14 is increased. This in turn requires additional torque at first driven gear 26 to drive drive shaft 28. This increased torque causes axial movement of drive shaft 28 against pivot arm 48 as a result of the axial force component exerted by first drive gear 24 against first driven gear 26. When the amount of axial force overcomes the preload of pivot arm 48 caused by tension spring 54, pivot arm 48 moves against and activates switch 56. Since the waste toner moves away from auger 14, drive shaft 28 does not continually bias switch 46 closed, but rather pulses switch 46 to cause a pulsed output train as shown by signal 56 in FIG. 2. The width of each pulse remains generally constant (Ti), while the frequency 62 between the rising edge of adjacent pulses varies depending upon the torque applied to auger 14 by the waste toner within container 12. Signal 56 illustrates a signal pulse train during a "not full" condition, "near full" condition and "full" condition of waste toner within container 12. More particularly, the frequency of activation of switch 46 to the left of point 64 on line 60 corresponds to a "not full" condition; a frequency of activation of switch 46 between point 64 and point 66 on line 60 represents a "near full" condition; and a frequency of activation of switch 46 to the right of point 66 on line 60 represents a "full" condition of waste toner within container 12.

Signal 58, as indicated above, represents a trace of an "enable time" generated by enable timer 38. Each enable time has a pulse width (T2) of a preset duration, which in the embodiment shown is selected to be constant. The pulse width T2 of each enable time is selected to be longer in duration than the pulse width T1 which occurs upon each activation of switch 46 by pivot arm 48. Each enable time begins at a leading edge of a pulse outputted by switch 46. If the switch activation pulse on signal trace 56 is low at the end of the enable time, the enable time resets to zero and starts anew at the beginning of the next switch pulse. On the other hand, if the pulse on signal trace 56 remains high at the end of the enable time (meaning that the frequency of activation of switch 46 is higher), then the enable timer continues to count without resetting to zero.

Referring now to line 60, the "accumulator value" calculated by controller 36 based upon switch pulse train 56 and enable time train 58 will be described in more detail. The accumulator value begins incrementing from a preset value (e.g., zero) at the rising edge of each enable time on pulse train 58. The incrementing is preset as a linear function in the embodiment shown, and has a preset gain or slope 68. In the embodiment shown, the accumulator value is incremented based upon the mathematical function:

$$\text{First gain} \times (\text{count value/unit of time});$$

Where "first gain" is the slope of the incrementing accumulator value, and "count value/unit of time" is the number of enable counts per preselected unit of time such as milliseconds. The rate at which the accumulator value linearly increases thus can be adjusted, depending upon the particular application.

At the end or trailing edge of each enable time, the accumulator value is decremented from the maximum accumulator value reached at the end of the enable time. The accumulator value is decremented using a linear function with a preset gain or slope 70. Gain 70 shown on line 60 during the decrementing phase of the accumulator value is the same as the gain 68 shown on the incrementing phase of the accumulator value, but may also be different from gain 68 if desirable. The decrementing of the accumulator value is carried out using the mathematical function:

$$\text{second gain} \times (\text{count value/unit of time});$$

where "second gain" is a predetermined constant and "count value/unit of time" is the number of counts by the enable timer per preselected unit of time such as milliseconds.

If the frequency of activation of switch 46 remains low, such as indicated by frequency period 62 on signal 56, the accumulator value decrements to the original preset value (e.g., zero) and remains low until the next switch activation. With the next switch activation, the enable timer again starts the enable time and the accumulator value again begins incrementing as shown by sloped portion 72 of line 60. This process of incrementing and decrementing the accumulator value continues with each pulse of switch 46. As long as the frequency of activation of switch 46 remains relatively low, the accumulator value decrements to at or near zero each time, which in turn retains the accumulator value below a first threshold value corresponding to a "near full" condition.

As the frequency of activation of switch 46 increases (such as indicated by line 74), the accumulator value has not decremented to the original zero state at the rising edge of the next activation pulse and the accumulator value begins to increment from the higher value. This in turn causes an elevation of the maximum accumulator value which allows the accumulator value to increase to a point at, near or above a first threshold value 75 as indicated at point 64 on line 60. When the accumulator value has a maximum value below first threshold value 74 (to the left of point 64), then the toner within waste toner container 12 is determined to be at a "not full" condition. When the maximum value of the accumulator value is above the first threshold value 74 (such as to the right of point 64), then the waste toner within waste toner container 12 is determined to be at a "near full" condition.

When the frequency of activation between rising edges of adjacent pulses increases to a point where the enable time overlaps the frequency, the enable time remains high (portion 76 of signal 58) which causes a continuous incrementing of the accumulator value as shown by portion 78 of line 60. The accumulator value increases to a second threshold value 80 at point 66. Between points 64 and 66, the accumulator value is deemed to be at the "near full" condition, and at or above point 66 the accumulator value is deemed to be at the "full" condition.

During operation, if the calculated accumulator value remains below the first threshold value 74, normal printing operation occurs. If the calculated accumulator value is at or above the first threshold value 74, a warning indicator such as an LED readout and/or alarm is provided to the user that the waste toner within waste toner container 12 is becoming full. If the calculated accumulator value is at or above the second threshold value 80, printing is halted by controller 36 until the user empties the waste toner from waste toner container 12. It may be necessary to have the user to instruct the controller to clear the accumulator value so that the controller starts with an assumed empty level of the accumulator value, and will begin to accept printing.

In the forgoing discussion of signals 56 and 58 and the accumulator value illustrated by line 60, the enable time calculated by the enable timer is assumed to be operable when an additional input signal is received indicating that auger 14 is being rotated. This eliminates strays caused by signal noise or the like.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In an image forming apparatus, a method of detecting waste toner in a container, comprising the steps of:

providing an auger within the container;

providing a switch which is operable dependent upon a torque associated with operation of said auger;

detecting a frequency of activation of said switch;

providing an enable timer which counts an enable time beginning at each activation of said switch;

decrementing an accumulator value dependent on said enable time; and determining at least one of a "not full", "near full" and "full" condition of the waste toner in the container, dependent upon said frequency.

2. The method of detecting waste toner of claim 1, wherein said enable time has preset duration.

3. The method of detecting waste toner of claim 2, wherein said enable time has a preset duration which is constant.

4. The method of detecting waste toner of claim 1, wherein said enable timer counts said enable time dependent upon rotation of said auger.

5. In an image forming apparatus, a method of detecting waste toner in a container, comprising the steps of:

providing an auger within the container;

providing a switch which is operable dependent upon a torque associated with operation of said auger;

detecting a frequency of activation of said switch;

determining at least one of a "not full", "near full" and "full" condition of the waste toner in the container, dependent upon said frequency; and providing an enable timer which counts an enable time beginning at each activation of said switch, said switch providing an activation pulse which remains high during activation, said enable timer refreshing said enable time if said activation pulse remains high at an end of said enable time.

6. In an image forming apparatus, a method of detecting waste toner in a container, comprising the steps of:

providing an auger within the container;

providing a switch which is operable dependent upon a torque associated with operation of said auger;

detecting a frequency of activation of said switch;

determining at least one of a "not full", "near full" and "full" condition of the waste toner in the container, dependent upon said frequency;

providing an enable timer which counts an enable time beginning at each activation of said switch; and incrementing an accumulator value based upon a quotient of a first gain and a count value of said enable timer.

7. The method of detecting waste toner of claim 6, wherein said calculating step comprises incrementing said accumulator value based upon the function:

first gain*(count value/unit of time).

8. The method of detecting waste toner of claim 6, including the step of comparing said accumulator value with a first threshold value, said determining step comprising:

determining said "not full" condition if said accumulator value is less than said first threshold value; and determining said "near full" condition if said accumulator value is greater than or equal to said first threshold value.

9. The method of detecting waste toner of claim 8, including the step of comparing said accumulator value with a second threshold value, said determining step comprising determining said "full" condition if said accumulator value is greater than or equal to said second threshold value.

10. The method of detecting waste toner of claim 6, including the step of decrementing said accumulator value based upon a quotient of a second gain and said count value of said enable timer.

11. The method of detecting waste toner of claim 10, wherein said decrementing step comprises decrementing said accumulator value based upon the function:

second gain*(count value/unit of time).

12. The method of detecting waste toner of claim 10, wherein said decrementing step begins at an end of said enable time.

13. The method of detecting waste toner of claim 10, wherein said determining step comprises providing a controller and a timer.

14. The method of detecting waste toner of claim 1, wherein said auger includes a driven gear, and further including the steps of:

providing a drive gear enmeshed with said driven gear and a drive shaft associated with said drive gear;

axially moving said drive shaft dependent upon said torque; and operating said switch using said movement of said drive shaft.

15. The method of detecting waste toner of claim 14, wherein said drive shaft carries said drive gear.

16. In an image forming apparatus, a method of detecting waste toner in a container, comprising the steps of:

providing an auger within the container;

providing a switch which is activatable dependent upon a torque associated with operation of said auger;

providing an enable timer which counts an enable time beginning at each activation of said switch;

incrementing an accumulator value based upon a quotient of a first gain and a count value of said enable timer;

comparing said accumulator value with at least one of a first threshold value and a second threshold value; and determining at least one of a "not full", "near full" and "full" condition of the waste toner in the container, including at least one of the following substeps:

determining said "not full" condition if said accumulator value is less than said first threshold value;

determining said "near full" condition if said accumulator value is greater than or equal to said first threshold value; and determining said "full" condition if said accumulator value is greater than or equal to said second threshold value.

17. The method of detecting waste toner of claim 16, including the step of decrementing said accumulator value based upon a quotient of a second gain and said count value of said enable timer.

18. The method of detecting waste toner of claim 17, wherein said decrementing step begins at an end of said enable time.

19. The method of detecting waste toner of claim 16, wherein said enable timer counts said enable time dependent upon rotation of said auger.

20. The method of detecting waste toner of claim 16, wherein said switch provides an activation pulse which remains high during activation, said enable timer refreshing said enable time if said activation pulse remains high at an end of said enable time.

* * * * *